US006844689B1

(12) United States Patent
Brown et al.

(10) Patent No.: US 6,844,689 B1
(45) Date of Patent: Jan. 18, 2005

(54) MULTIPLE BEAM LINEAR ACCELERATOR SYSTEM

(75) Inventors: David A. Brown, Kanata (CA); David J. Hepworth, Kanata (CA)

(73) Assignee: Mevex Corporation, Stittsville (CA)

( * ) Notice: Subject to any disclaimer, the term of this patent is extended or adjusted under 35 U.S.C. 154(b) by 0 days.

(21) Appl. No.: 10/650,673

(22) Filed: Aug. 29, 2003

(51) Int. Cl.[7] ..... H01J 23/00

(52) U.S. Cl. ..... 315/505; 315/5.43; 315/39.51; 315/39.53

(58) Field of Search ..... 315/505, 500, 315/5.41, 5.43, 39.51, 39.53, 39.55

(56) References Cited

U.S. PATENT DOCUMENTS 4,713,581 A * 12/1987 Haimson ..... 315/5.41
5,744,919 A * 4/1998 Mishin et al. ..... 315/505
6,593,579 B2 * 7/2003 Whithman ..... 250/423 F

* cited by examiner

*Primary Examiner*—Haissa Philogene
(74) *Attorney, Agent, or Firm*—L. Anne Kinsman; Borden Ladner Gervais LLP

(57) ABSTRACT

A multiple beam linear accelerator system and method where two or more accelerator waveguides are driven by a single high power microwave source. A single RF power system is multiplexed to drive the plurality of accelerator waveguides. Each accelerator waveguide is addressed at a different RF frequency, and the microwave source generates pulses at the appropriate RF frequency for each accelerator waveguide on a pulse-by-pulse basis.

21 Claims, 3 Drawing Sheets

MULTIPLE BEAM LINEAR ACCELERATOR SYSTEM

FIELD OF THE INVENTION

The present invention relates generally to linear accelerators. More particularly, the present invention relates to multiple beam linear accelerator systems and their control.

BACKGROUND OF THE INVENTION

A linear accelerator, or linac, is a device used to accelerate electrons to high velocities. For most applications involving particle energies of greater than 1 MeV, radio frequency linear accelerators, or RF linear accelerators, are used. RF linear accelerators have many medical and industrial applications, including radiation therapy, medical and food product irradiation, polymer cross-linking, pest control, ion implantation in semiconductor production, and non-destructive testing.

A block diagram of a simplified RF linear accelerator system is shown in FIG. 1. The linear accelerator system 10 generally consists of an RF generator 11 to generate high power microwave pulses that set up electric fields in a linear accelerator waveguide 24, which are then used to accelerate electrons supplied by an electron gun 14 to produce a high-energy electron beam OUT. The accelerated electron beam strikes a target to produce the desired effect appropriate for the application. The RF power required to set up these accelerating fields is typically in the range of megawatts. Such power can only be produced in very short pulses, typically 1 $\mu$s to 20 $\mu$s. The RF generator 12 requires high voltage pulses and high amperage current to operate. The pulses to operate the RF generator 12 are created in a modulator 16. The modulator 16 requires high voltage DC, which is produced in a high voltage (HV) supply 18.

The function of the HV supply 18 is to produce the high voltages required for proper modulator operation. A typical modulator requires 10 to 12 kV at power levels of 10 to 100 kW. The HV supply 18 is generally regulated, filtered, and has some type of feedback of both the voltage and current.

The RF generator 11 uses an RF power device 12, such as a klystron, magnetron or other microwave source. The RF power device 12 requires an input control signal. In the case of a klystron, as illustrated in FIG. 1, this input control signal is provided by an RF driver 20. The output of the RF power device 12, is fed to a circulator 22, which buffers the microwave source from the accelerator waveguide 24. The accelerator waveguide 24 represents a highly dynamic load. At the beginning of a pulse, the waveguide 24 appears as a mismatch, and most of the RF power is reflected back towards the source 12. The reflected power is absorbed by a load 26 attached to one of the ports of the circulator 22.

The function of the modulator 16 is to provide high voltage pulses to the RF generator 11. The components of a typical modulator include a charging inductor, a pulse-forming network, a charging diode, a power switch tube, such as a thyratron, and a pulse transformer. In operation, the modulator 16 undergoes a charging cycle and a discharging cycle. On the charging cycle, the charging inductor and the capacitance of the pulse-forming network form a resonant circuit. This resonance causes the pulse-forming network to charge up to twice the voltage supplied by the HV supply 18. The charging diode keeps the pulse-forming network voltage at full voltage until the discharge cycle is initiated. The discharge cycle is initiated by conduction of the power switch. The components that operate in the discharge cycle are the power switch, the pulse forming network, the pulse transformer and RF power device 12 (klystron or magnetron). The discharge cycle results in a high voltage pulse appearing across the input of the RF power device 12.

Since the accelerator waveguide 24 operates at a very narrow range of frequencies, it is important that the RF generator 11 operate at the correct frequency. As the waveguide 24 heats up, the operating frequency shifts, requiring the RF generator 11 to track the change so as to maintain maximum output. Typically, there is an automatic frequency control circuit in the system 10 to automatically adjust the RF generator 11 to the correct frequency.

The preceding discussion outlines the general operation of a single beam linear accelerator. Multiple beam linear accelerator systems are also now in demand for many applications. Currently, multiple beam systems merely duplicate the components of the single beam system, and provide a common control and power platform. The klystrons and HV supplies are particularly expensive components when duplicated in a multiple beam system. Therefore, it is desirable to provide a multiple beam linear accelerator system that requires only one microwave source and ideally, only one HV supply.

SUMMARY OF THE INVENTION

It is an object of the present invention to obviate or mitigate at least one disadvantage of previous multiple beam linear accelerator systems. It is a particular object of the present invention to provide a multiple beam linear accelerator system that requires fewer components than previous systems, and a method of generating high voltage RF pulses to multiple linear accelerator waveguides without duplicating all the components of the pulse generation system for each waveguide.

According to a first aspect, the present invention provides a multiple beam linear accelerator system. The multiple beam accelerator system comprises at least two linear accelerator waveguides. The two linear accelerator waveguides are tuned to different resonant frequencies that are spaced apart to allow only one of the linear accelerator waveguides to accept a given high power radio frequency (RF) pulse. In the case of a klystron system, an RF generator provides low power RF signals to the klystron alternately at the different resonant frequencies, while a modulator provides appropriate high voltage pulses to the klystron in synchronization with the RF signals. The RF power device, such as a klystron, provides high power RF pulses alternately at the different resonant frequencies.

In another aspect, the present invention provides a high power RF pulse supply system for a multiple beam linear accelerator system having more than two linear accelerator waveguides. The pulse supply system comprises an RF generator including an RF power device for providing high power RF pulses alternately at differing frequencies corresponding to the resonant frequency of each linear accelerator waveguide. The resonant frequencies are chosen such that substantially only one of the linear accelerator waveguides accepts high power RF pulses at each differing frequency. In the case of a klystron system, an RF driver provides low power RF signals to the RF power device alternately at the differing frequencies, while a modulator provides high voltage pulses to the RF power device in synchronization with the RF signals.

In presently preferred embodiments of the multiple beam linear accelerator system and pulse supply system, a circulator system or network, preferably a four-port circulator, is used to direct the high power RF pulse, typically a microwave pulse, to the appropriate linear accelerator waveguide. If N is the number of linear accelerators, then the system will require N−1 circulators to properly direct the flow of high power microwaves. A high voltage power supply supplies alternating high voltage inputs to the modulator in accordance with the different resonant frequencies, and the RF signals and the high voltage power inputs are appropriately multiplexed to the modulator under the control of a control system. For microwave generation, a 1.0 to 1.5 MHz separation between the resonant frequencies of each linear accelerator waveguide has been found to be sufficient.

In a further aspect, the present invention provides a method for controlling a single radio frequency source to supply a plurality of linear accelerator waveguides in a multiple beam linear accelerator. The resonant frequency of each of the plurality of linear accelerator waveguides are chosen such that only one linear accelerator waveguide accepts a pulse generated at a given frequency. The method comprises steps of generating an RF signal having a frequency corresponding to a resonant frequency of one of the plurality of linear accelerator waveguides. A high power RF pulse is also generated at the frequency. The high power RF pulse is then directed to the linear accelerator waveguide having a resonant frequency corresponding to the frequency. These steps are repeated on a pulse-by-pulse basis to alternate between different frequencies corresponding to resonant frequencies of the multiple linear accelerator waveguides. In presently preferred embodiments of the present invention, the high voltage control signals are multiplexed to a PFN charger and the RF frequency control signals are multiplexed to an RF power device. The method can also include generating pulses for any of automatic frequency control, beam monitoring, and forward and reflected power monitoring.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a multiple beam linear accelerator system where two or more accelerator waveguides are driven by a single high power microwave device. The present invention relies upon a multiplexed RF power system for driving the plurality of accelerator waveguides. Each accelerator waveguide is addressed at a different RF frequency, and the high power microwave device generates pulses at the appropriate RF frequency and power for each accelerator waveguide.

Figure 1:
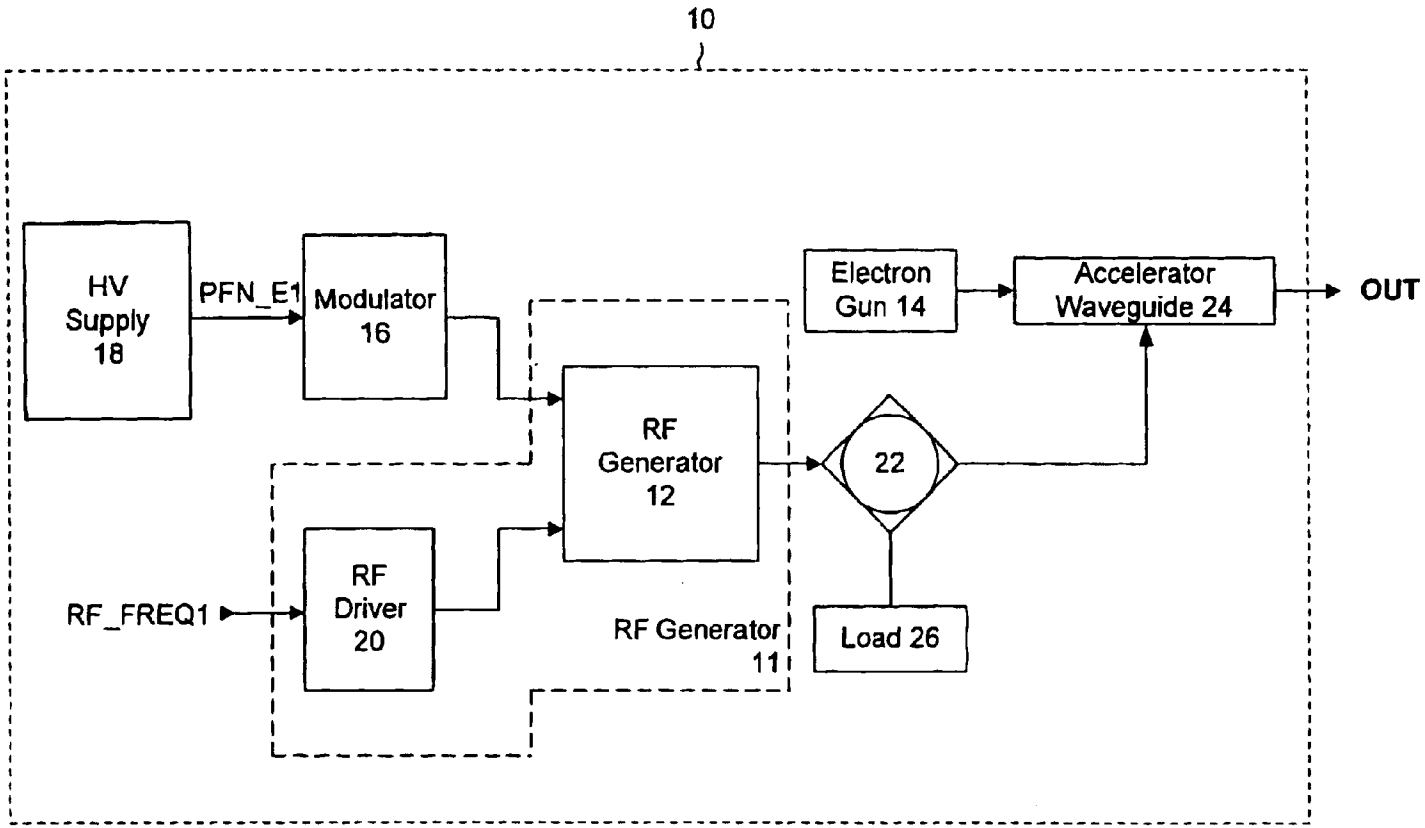
Figure 1 (Prior Art)
FIG. 1 is a block diagram of a typical prior art linear accelerator system.
Figure 2:
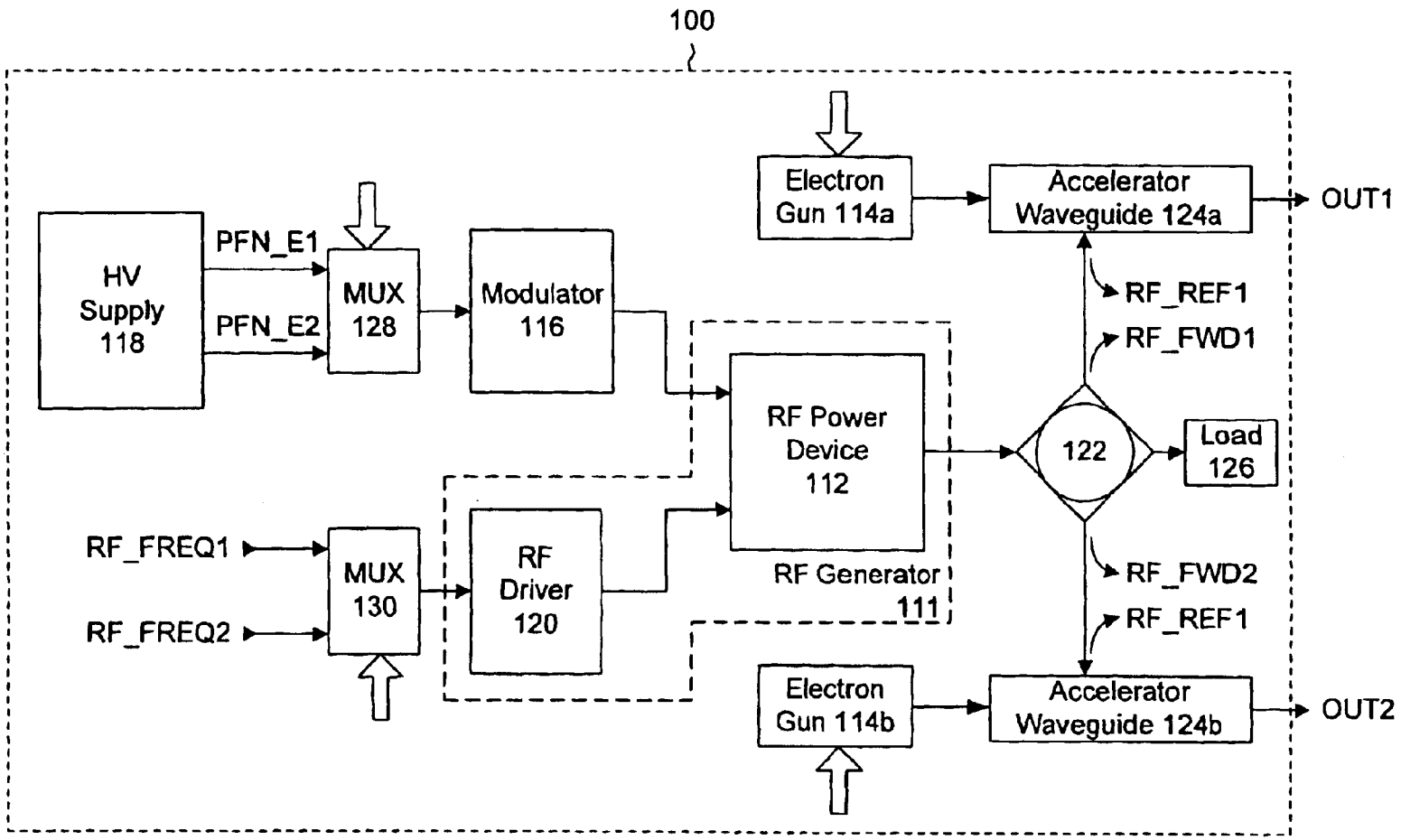
FIG. 2 is a block diagram of a multiple beam linear accelerator system according to the present invention.

Referring to FIG. 2, a block diagram of a linear accelerator according to an embodiment of the present invention, and generally indicated at reference numeral 100, is shown. System 100 illustrates a dual-beam linear accelerator system having two linear accelerator waveguides 124*a* and 124*b*. As will be apparent to those of skill in the art, the present invention can be applied to systems having two or more accelerator waveguides. Generally, the invention requires resonant accelerator waveguides to function. Two electron guns 114*a* and 114*b* inject electron beams into the linear accelerator waveguides 124*a* and 124*b*, respectively, to produce accelerated electron beams OUTI and OUT2. The accelerated electron beams can be spatially oriented in any direction relative to one another. A circulator system 122, typically a network of circulators or multi-port circulator, with a load 126 placed on one port, performs traffic control by allowing microwave power that is rejected from one accelerator waveguide to be forwarded to another accelerator waveguide. If N is the number of linear accelerators, then the system will require N−1 circulators to properly direct the flow of high power microwaves.

The accelerator waveguides 124*a* and 124*b* are driven by a single high power RF power device 112, which can be a klystron, magnetron or other high power microwave device. In the illustrated embodiment, where the RF power device 112 is a klystron, the RF power device 112 in combination with an RF driver 120 forms an RF generator 111 As will be understood by those of skill in the art, the actual configuration of the RF generator 111 will depend on the RF power device used. High voltage pulses are supplied to the RF power device 112 by a modulator 116. The modulator 116, which includes a high voltage switch, receives high voltage inputs PFN_E1 and PFN_E2 from a HV supply 118. The high voltage inputs are multiplexed to modulator 116, preferably on a pulse-by-pulse basis as is further described below, by a multiplexer (MUX) 128.

RF control signals RF_FREQ1 and RF_FREQ2, provided by the control system, are multiplexed to the RF driver 120 by a multiplexer 130. In a presently preferred embodiment, the high power RF power device 112 is controlled on a pulse-by-pulse basis. The frequency of the pulse can be controlled over a long or short time base. Control pulses supplied to the multiplexers 128 and 130, as well as the electron guns 114*a* and 114*b*, are indicated by the open arrows. A trigger, or control, system (not shown) generates the control pulses to select which high power pulse and RF signal is generated, and, consequently, which accelerator waveguide accepts the microwave power and generates an electron beam pulse. The trigger system can also generate auxiliary trigger pulses for automatic frequency control, beam monitoring, and forward and reflected power monitoring.

Figure 3:
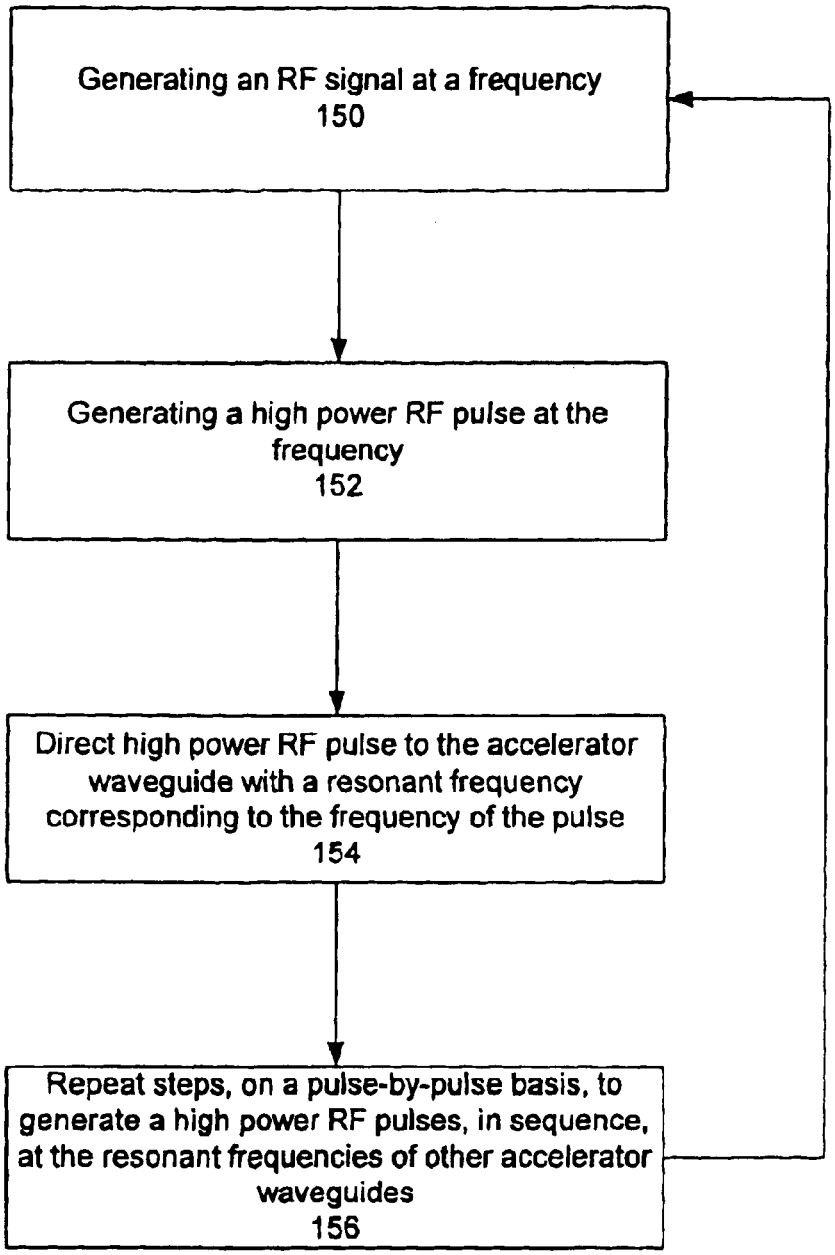
FIG. 3 is a flowchart of a method for controlling a single High Power Microwave Device to supply a plurality of linear accelerator waveguides in accordance with the present invention.

Referring to FIGS. 2 and 3, the generalized method of the present invention is illustrated in the flowchart of FIG. 3. The method commences with generating an RF signal at step 150. The RF signal has a frequency substantially corresponding to a resonant frequency of one of the plurality of linear accelerator waveguides 124*a* and 124*b*. A high power RF pulse is then generated by the RF generator 111 in synchronization with the RF signal at step 152. The high power RF pulse is then directed to the linear accelerator waveguide having a resonant frequency corresponding to the frequency of the RF signal at step 154. These steps are repeated, at step 156, on a pulse-by-pulse basis, to switch between all the different frequencies corresponding to the resonant frequencies of the multiple linear accelerator waveguides.

The present invention effectively multiplexes the high power RF pulses provided by the RF power device 112. This multiplexing is achieved by providing accelerator waveguides tuned to different resonant frequencies that are sufficiently set apart such that only one accelerator waveguide at a time accepts a high power RF power pulse generated by the RF power device 112, while the other accelerator waveguides in the system appear as mismatches to the pulsed energy. In other words, the accelerator waveguide that accepts the high power RF pulse will be in resonance, while the other waveguides in the system will appear as mismatches to the pulse. Thus, the selection of accelerator waveguides is based on their frequency separation. For example, successful trials have been conducted with two accelerator waveguides having frequencies of 2995.97 MHz and 2996.85 MHz, and bandwidths of 430 kHz and 190 kHz, respectively. This resulted in a separation of approximately 1 MHz. The frequency separation can also be affected by differentially heating the accelerator waveguides. For example, heating one of the accelerator waveguides by only a few degrees can make a significant difference to the frequency separation.

Generally, at microwave frequencies it has been found that a frequency separation of approximately 850 kHz is the lower limit to have the non-operating accelerator waveguide appear as a short circuit and not absorb a significant portion of the off-frequency high power RF pulse, thus keeping accelerator waveguide interaction to a minimum. Any interaction is virtually removed by increasing the separation to 1.3 MHz. Thus, separations of between 1.0 and 1.5 MHz are considered optimal for operation of the present invention using conventional RF drivers. Any method of separating the frequencies will enable the invention. For example, two accelerators with the same frequency could be operated with a temperature difference of 20° C. to achieve the desired separation of 1 MHz.

To switch between the input frequency signals RF_FREQ1 and RF_FREQ2, the RF signal source used in the RF driver 120 can have its output frequency set by a voltage on a control pin. The frequency can be changed on a pulse-to-pulse basis by switching the control voltage between the two levels corresponding to the frequencies required. The signals are passed to multiplexer 130. The multiplexer 130 is preferably set up to allow the correct frequency control signal to be present for the next trigger pulse. Preferably, filtering is provided to prevent noise signals affecting the RF signal source performance.

In presently preferred embodiments of the present invention, the high voltage signals and the RF signals are both multiplexed to the RF power device 112. The method can also include generating pulses for any of automatic frequency control, beam monitoring, and forward and reflected power monitoring.

The automatic frequency control (AFC) system to be used with the drive technique of the present invention is preferably a phase-detect AFC. The Phase-detect AFC samples forward and reverse RF signals RF_FWD_1, RF_FWD_2, RF_REF_1, and RF_REF_2, respectively, and generates error signals to control the source frequency. The system response relies on the normal phase vs. frequency response of a resonant cavity to establish the correct frequency setting. It is quite conceivable that conditions could arise where the AFC of the second accelerator waveguide locks into the wrong loop. There are a number of software techniques that can be employed to solve the problem. These techniques include a programmable logic control (PLC) program that does not allow the frequency set levels of the source to be the same for multiple accelerator waveguides. In the event that the AFC loop tries to make them the same, the error signal for the second accelerator increases the value until the higher frequency lock occurs. Alternately, at switch-on, the PLC sets the start frequencies so that one accelerator waveguide is always low, and moves up to resonance, and the other accelerator waveguides are always high and move down to resonance. Thirdly, if an accelerator waveguide arcs, and potentially loses AFC control, a repeat of the start-up condition is automatically applied for that accelerator waveguide. A combination of these techniques can be used to ensure correct operation.

The insertion loss between the RF power device 112 and each accelerator waveguide is different. In reality, the second accelerator waveguide 124*b* will see a greater insertion loss, as the high power RF pulse has to travel twice through the circulator system 122. The high power RF pulse for accelerator waveguide 124*b* will also have been reflected by accelerator waveguide 124*a*. Even with the frequency separation used, a small percentage of the RF power will be absorbed by accelerator waveguide 124*a*. The operating characteristics of each accelerator are bound to be somewhat different and may require slightly different RF powers to optimize the beam. Thus, preferably the RF power device 112 should generate different powers for each accelerator waveguide.

Generating different high voltage inputs can be achieved using HV power pulse-to-pulse control, and multiplexing of alternate pulse energies. In a presently preferred embodiment, the HV power supply 118 operates as follows. The PFN is charged to the required energy as set by the multiplexed PFN control signal. Precise energy control of each pulse is achieved by using feedback circuits and IGBTs, as is well understood by those of skill in the art As will be apparent to those of skill in the art, the present invention provides a multiple beam linear accelerator system requiring only one RF power device for powering multiple linear accelerator waveguides. The present invention reduces the number of RF components and hence the cost of the linear accelerator system.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A multiple beam linear accelerator system, comprising:

at least two linear accelerator waveguides, the at least two linear accelerator waveguides tuned to different resonant frequencies spaced apart to allow only one of the at least two linear accelerator waveguides to accept a given high power radio frequency (RF) pulse;

an RF generator, including an RF power device, for providing high power RF pulses alternately at the different resonant frequencies; and a modulator for providing high voltage pulses to the RF power device in synchronization with RF signals.

2. The multiple beam linear accelerator system of claim 1, wherein the RF signals are microwave signals.

3. The multiple beam linear accelerator system of claim 2, wherein the different frequencies are spaced apart by at least a minimum separation required to allow power to be directed to one accelerator at a time.

4. The multiple beam linear accelerator system of claim 3, wherein the minimum separation is approximately 1.0 MHz.

5. The multiple beam linear accelerator system of claim 1, further including a circulator system for directing the high power RF pulses.

6. The multiple beam linear accelerator system of claim 5, wherein the circulator system is a multi-port circulator.

7. The multiple beam linear accelerator system of claim 1, further including a high voltage power supply for supplying addressed high voltage inputs to the modulator in accordance with the different resonant frequencies.

8. The multiple beam linear accelerator system of claim 1, wherein the RF power device is a klystron and the RF generator includes an RF driver.

9. The multiple beam linear accelerator system of claim 1, further including a control signal multiplexer for determining an RF input signal to provide to the RF driver.

10. The multiple beam linear accelerator system of claim 1, further including a control system for synchronizing the RF signals and high voltage inputs to the modulator, and for triggering the high voltage RF pulses to the RF power device.

11. A high power radio frequency (RF) pulse supply system for a multiple beam linear accelerator having a plurality of linear accelerator waveguides, comprising:

an RF generator, including an RF power device, for providing high power RF pulses in sequence at differing frequencies corresponding to resonant frequencies of the plurality of linear accelerator waveguides, the resonant frequencies chosen such that substantially only one of the plurality of linear accelerator waveguides accepts high power RF pulses at each differing frequency; and a modulator for providing high voltage pulses to the RF power device in synchronization with RF signals.

12. The high power RF pulse supply system of claim 11, wherein the RF signals are microwave signals.

13. The high power RF pulse supply system of claim 11, further including a network of circulators for directing the high power RF pulse to one of the plurality of linear accelerator waveguides.

14. The high power RF pulse supply system of claim 11, further including a high voltage power supply for supplying addressed high voltage inputs to the modulator in accordance with the differing frequencies.

15. The high power RF pulse supply system of claim 11, wherein the RF power device is a klystron, and the RF generator further includes an RF driver.

16. The high power RF pulse supply system of claim 15, further including a multiplexer for determining a control signal to provide to the RF driver.

17. The high power RF pulse supply system of claim 11, further including a control system for synchronizing the RF signals and high voltage inputs to the modulator, and for triggering the high voltage RF pulses from the RF power device.

18. A method for controlling a single RF power device to supply a plurality of linear accelerator waveguides in a multiple beam linear accelerator, comprising the steps of:

(i) generating an RF signal having a frequency corresponding to a resonant frequency of one of the plurality of linear accelerator waveguides;

(ii) generating a high power RF pulse at the frequency;

(iii) directing the high power RF pulse to one of the plurality of linear accelerator waveguides having a resonant frequency corresponding to the frequency; and (iv) repeating steps (i) to (iii) on a pulse-by-pulse basis to alternate between different frequencies corresponding to resonant frequencies of the plurality of linear accelerator waveguides, the resonant frequency of each of the plurality of linear accelerator waveguides chosen such that only one of the plurality of linear accelerator waveguides accepts a pulse generated at a given frequency.

19. The method of claim 18, wherein the step of providing the RF signal includes multiplexing between a plurality of RF signals.

20. The method of claim 18, wherein the step of providing the high power RF pulse includes multiplexing between a plurality of high voltage control inputs.

21. The method of claim 18, further including tapping pulses for any of automatic frequency control, beam monitoring, and forward and reflected power monitoring.

* * * * *